US007182309B1

(12) United States Patent
Olsen

(10) Patent No.: US 7,182,309 B1
(45) Date of Patent: Feb. 27, 2007

(54) CONCRETE CURBING FORMING DEVICE

(76) Inventor: Bret R. Olsen, 19810 Grandview Dr., Corona, CA (US) 92881

( * ) Notice: Subject to any disclaimer, the term of this patent is extended or adjusted under 35 U.S.C. 154(b) by 253 days.

(21) Appl. No.: 10/926,412

(22) Filed: Aug. 26, 2004

(51) Int. Cl.
*E04G 17/14* (2006.01)

(52) U.S. Cl. ..... 249/219.1; 249/2; 269/37

(58) Field of Classification Search ..... 249/8, 249/208, 34, 2, 3, 4, 5, 6, 7, 14, 210, 219.1; 33/404, 405; D8/355; 269/37, 45, 901, 269/904, 909, 910
See application file for complete search history.

(56) References Cited

U.S. PATENT DOCUMENTS

| | | | | | |
|---|---|---|---|---|---|
| 657,802 | A | * | 9/1900 | Watson | 249/2 |
| 765,360 | A | * | 7/1904 | Hanlon | 249/208 |
| 995,048 | A | * | 6/1911 | Wiltfong | 249/8 |
| 1,016,285 | A | * | 2/1912 | Meek | 249/167 |
| 1,020,164 | A | * | 3/1912 | Symons | 269/208 |
| 1,245,840 | A | * | 11/1917 | Warner | 249/2 |
| 1,279,059 | A | * | 9/1918 | Whiteway et al. | 249/8 |
| 1,466,830 | A | * | 9/1923 | Hayward | 249/210 |
| 1,628,316 | A | * | 5/1927 | Heltzel | 249/5 |
| 1,644,584 | A | * | 10/1927 | Heltzel | 249/5 |
| 1,644,586 | A | * | 10/1927 | Heltzel | 249/5 |
| 1,644,587 | A | * | 10/1927 | Heltzel | 249/208 |
| 1,672,760 | A | * | 6/1928 | Heltzel | 249/208 |
| 1,674,042 | A | * | 6/1928 | Hickey | 249/208 |
| 2,610,660 | A | * | 9/1952 | Jennings et al. | 269/90 |
| 2,635,320 | A | * | 4/1953 | Ornitz | 249/5 |
| 2,688,174 | A | * | 9/1954 | Hogan | 249/208 |
| 2,873,529 | A | * | 2/1959 | Hogan et al. | 404/61 |
| 2,894,307 | A | * | 7/1959 | Hogan et al. | 249/208 |
| 2,894,310 | A | * | 7/1959 | Hogan et al. | 249/208 |
| 2,908,959 | A | * | 10/1959 | Hogan et al. | 249/208 |
| 2,965,950 | A | * | 12/1960 | Wilson | 249/208 |
| 2,997,768 | A | | 8/1961 | Torrelli | |
| 4,029,288 | A | | 6/1977 | Murphy et al. | |
| 4,291,858 | A | | 9/1981 | NeSmith | |
| 4,300,754 | A | * | 11/1981 | Lawrence | 269/8 |
| 4,494,725 | A | | 1/1985 | Sims | |
| 4,723,752 | A | * | 2/1988 | Thomas | 249/219.1 |
| 5,048,781 | A | | 9/1991 | Breen | |
| 5,156,753 | A | * | 10/1992 | Speidel | 249/5 |
| 5,562,272 | A | | 10/1996 | McAbee et al. | |
| 6,409,422 | B1 | | 6/2002 | Mittermaier et al. | |

FOREIGN PATENT DOCUMENTS

| | | | | |
|---|---|---|---|---|
| FR | 2 575 208 | * | 6/1986 | 249/34 |

* cited by examiner

*Primary Examiner*—Michael Safavi
(74) *Attorney, Agent, or Firm*—Gordon K. Anderson

(57) ABSTRACT

A cleat device (20) is taught for forming concrete curbing that jointly retains a back board form (22) and a front board form (24) with a spreader (25) spaced apart between the forms. The cleat device consists of three basic elements first a right angle shaped cleat back (26) having a top (28) and leg (30) configured to intimately engage and retain the back board form. Second a cleat arm (44) that includes a top arm (46) and an acute angled downwardly depending member (48) attached to the cleat back top forming an inverted channel. The third element is a cleat leg (58) that is attached to the downwardly depending member allowing the cleat leg to be adjusted vertical or at an acute angle. Adjustment means provide a cleat device capable of supporting the back board and front board form with a spreader in-between while constructing a L-curb and gutter, a A-22 curb or a A-90 curb configuration.

19 Claims, 5 Drawing Sheets

46
48
44
56
50
40'

46
56
40'
44
48
40'
52

50
44
46
48
56
40'

50
37'
52
48
44

50
48
52
37'
44

58
37"
52'
56'
37'
54'
52'
54'

58
52'
56'
52'

52'
37"
58
52'

52'
58
37"
52'

56'
58

CONCRETE CURBING FORMING DEVICE

TECHNICAL FIELD

The present invention relates to curb forming devices or cleats in general. More specifically to an adjustable cleat for forming so called concrete L-curbs, A-22 curbs and A-90 curbs.

BACKGROUND ART

Previously, many types of cleats, brackets, forms, clamps etc. have been used in endeavoring to provide an effective means to hold wood forms in place while pouring concrete into the form during the construction of a curb.

A search of the prior art did not disclose any patents that possess the novelty of the instant invention; however the following U.S. patents are considered related:

| U.S. Pat. No. | Inventor | Issue Date |
|---|---|---|
| 2,997,768 | Torrelli | Aug. 29, 1961 |
| 4,029,288 | Murphy et al. | Jun. 14, 1977 |
| 4,291,858 | NeSmith | Sep. 29, 1981 |
| 4,494,725 | Sims | Jan. 22, 1985 |
| 5,048,781 | Breen | Sep. 17, 1991 |
| 5,562,272 | McAbbe et al. | Oct. 8, 1996 |
| 6,409,422 | Mittermaier et al. | Jun. 25, 2002 |

Wilson in U.S. Pat. No. 2,956,950 teaches a curb form clamp for supporting the form boards during the pouring of concrete, consisting of assemblies which grip top portions of the form boards held in spaced relation with wedges that are actuated by driving the wedge from the clamp for quick removal.

U.S. Pat. No. 2,997,768 issued to Torrelli is for a curb form clamp having a high upright back rail and a low upright front rail with spacing plates between the rails.

Murphy et al. in U.S. Pat. No. 4,029,288 discloses a bracket for releasably holding two concrete form walls with the brackets, each having a horizontal crosspiece with downwardly projecting legs. The bracket includes holding means attaching crosspieces above the concrete.

NeSmith in U.S. Pat. No. 4,291,858 teaches a clip arrangement for spacing apart and holding together concrete forms having a single wire base strut with attached vertically extending arms.

U.S. Pat. No. 4,494,725 issued to Sims discloses a retainer for supporting wooden form members during the pouring of concrete for curbs and gutters. The retainer consists of a pair of spaced horizontal members joined at their end to front and rear bars, the rear of which is vertical, while the front is vertical at its upper portion and extends outward to a point of termination.

Breen in U.S. Pat. No. 5,048,781 discloses a bracket for supporting concrete forms in a predetermined spaced relationship having an elongated horizontal member along with a pair of depending members. Each pair of inner and outer spaced arm members engage the concrete form and are adjustable in distance between forms.

U.S. Pat. No. 5,562,272 of McAbbe et al. disclose splicers for construction forms having form reinforcing brackets to support the upper end of a form for curb construction, consisting of linear metallic channel members. Each channel member has a width that tightly receives abutting forms and has sidewalls of differing heights.

For background purposes and as indicative of the art to which the invention is related reference may be made to the remaining cited patent issued to Mittermaier et al. in U.S. Pat. No. 6,409,422.

DISCLOSURE OF THE INVENTION

Concrete curbs are universally used throughout the entire world and have been in existence for countless years. A conventional method of fabricating a curb is to utilize wood board forms on each side of the curb creating a footing held in place with wood stakes and wood cross ties nailed together. The footing board forms are usually lengths of standard 2×10 or 2×12 and 2×6 planks which may have been sprayed with a form release agent. The cross tie is usually a 1×2 wood strip nailed to the footing board forms since there is considerable pressure exerted to force the forms apart by the weight of the fluid concrete. When a curved curb is required a ¼ inch thick Masonite board or ½ inch thick plywood board replaces the planks to permit bending around the stakes. When the forms are in place the concrete is poured and the top surface is floated. The curb itself usually sets in a few hours to sufficiently stand alone. The cross ties, stakes and footing board forms are then manually removed A primary object of the invention is to reduce labor when constructing a curb or footing structure. It is apparent that the conventional technique of preparing footings consumes considerable manual labor to drive in wood stakes, that have the propensity to split and crack, and have limited life due to the nailing requirements, as well as hand nailing the cross ties having the same limitations. The present invention clearly reduces labor as the cleat is unitary and replaces the stakes while automatically spacing the two footing boards apart at a predetermined distance. The spacer boards are oppositely positioned against flanges on the cleat and a spreader is placed between the boards to hold the boards apart. The spreader is removed when the concrete is poured to the proper level thereafter holding the boards in position until pouring is completed.

An important object of the invention utilizes standard wood boards that are already in use with the conventional methods and the stakes and cross ties are replaced by the cleat device and a small simple wood spreader.

Another object of the invention utilizes spreaders that are easily removed during the pouring process and then carrying out the pour to the top thereby completely eliminating the requirement for downwardly depending arm members that hold the top inside of the board, as noted in certain prior art that has been previously developed and patented to accomplish the same task.

Still another object of the invention is its adaptability, as the cleat device is adjustable to accommodate both angular curbs, straight sided curbs and combined curbs and gutters. The cleat is adjusted by removing four carriage bolts with wing nuts and setting the angle to 22 degrees for the front of the curb or a 90 degree parallel front and back. The cleat is also adjustable in width of from 4.50 to 10.00 inches (11.43 cm to 25.4 cm) between the back leg and the cleat arm in 0.50 inch (1.27 cm) increments.

Yet another object of the invention is directed to its robust construction as it amply strong enough to withstand the outwardly directed pressure of fluid concrete pressing against the forms during pouring and will withstand being driven in the ground repeatedly in some applications. Further nail holes in the flanges of the cleat permit nailing to the board forms in some applications where required.

A further object of the invention overcomes difficulty in driving the device into rocky or hard ground as, unlike a wood stake, the cleat device is metal and therefore relatively thin compared to a wood stake. Since the device is metal it does not require sharpened ends that could be dangerous instead the driven ends are radiused which accomplishes the same utility and is still easy to insert by force.

A final object of the invention is the ease of removal from the ground as it may be pulled upwardly by hand due to its thin and flat configuration. Storage is also easily accomplished as the cleat device is small and may nest together consuming a minimum of space.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
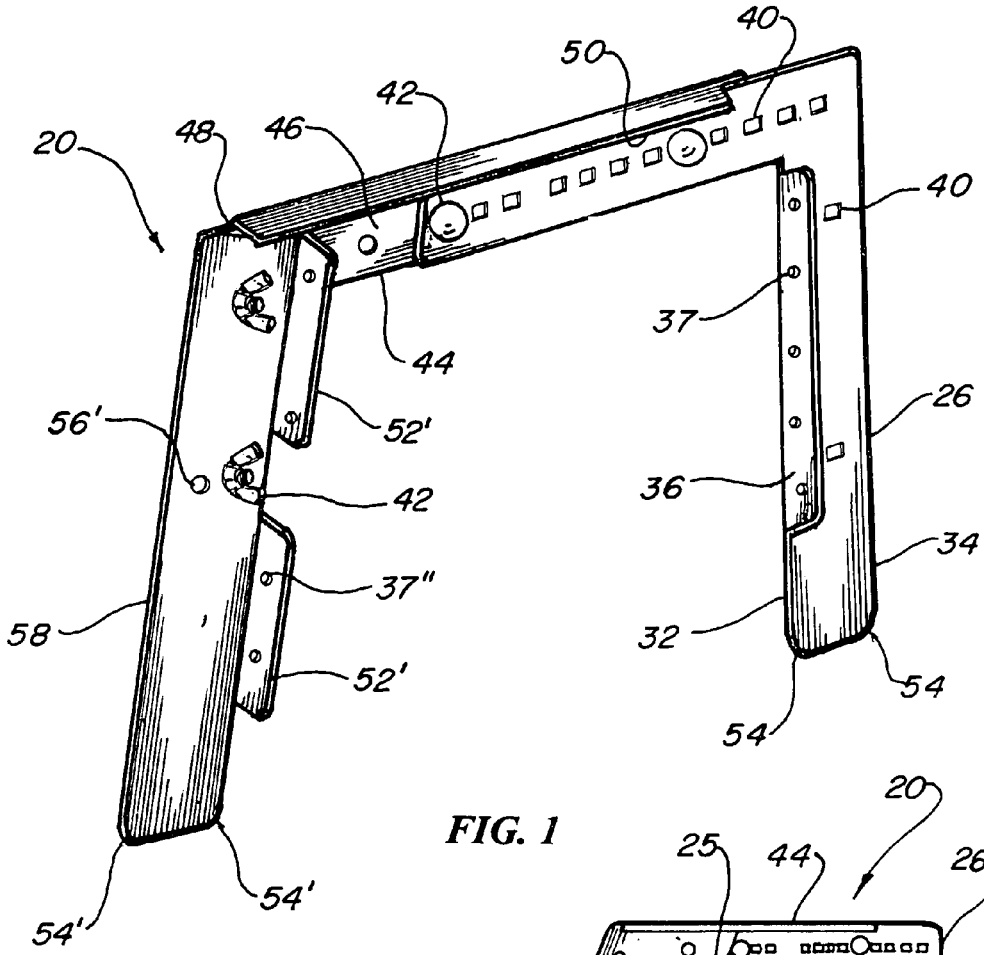
FIG. 1 is a partial isometric view of the cleat device in the preferred embodiment.

The best mode for carrying out the invention is presented in terms of a preferred embodiment and functions to provide forming to pour concrete curbing. This preferred embodiment of the cleat device 20 is shown in FIGS. 1 thorough 26 and is configured to jointly retain a wooden back board form 22 and a wooden front board form 24 with a spreader 25 spaced apart in-between.

The cleat device 20, illustrated assembled in FIG. 1, includes a right angle shaped cleat back 26, having an integral horizontal back top 28 and a integral downwardly depending back leg 30, configured to intimately engage and retain the back board form 22. The cleat back downwardly depending back leg 30 has an inner edge 32 and an outer edge 34 with a right angle flange 36 formed on the inner edge 32, as shown best in FIGS. 11–15. The right angle flange 36 includes a plurality of nail holes 37 for nailing the back board 22 in place eliminating the necessity of the spreader 25 or when required by the application.

Figure 12:
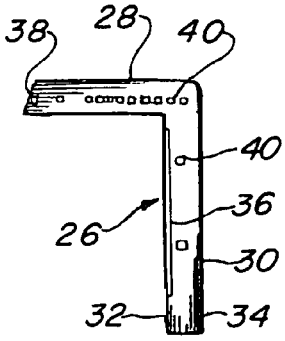
FIG. 12 is a front view of the right angle cleat back in the preferred embodiment.
Figure 11:
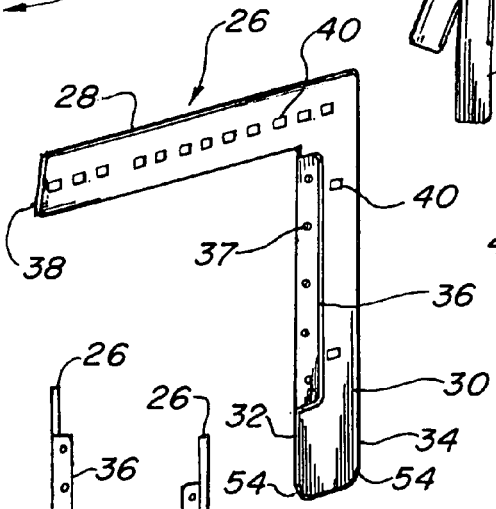
FIG. 11 is a partial isometric view of the right angle cleat back in the preferred embodiment.
Figure 15:
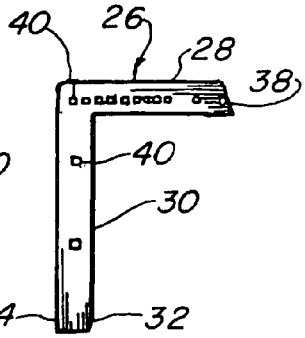
FIG. 15 is a rear view of the right angle cleat back in the preferred embodiment.
Figure 13:
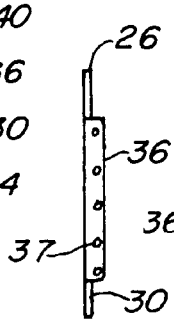
FIG. 13 is a right side view of the right angle cleat back in the preferred embodiment.
Figure 14:
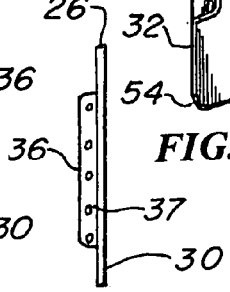
FIG. 14 is a left side view of the right angle cleat back in the preferred embodiment.
Figures 16, 17, 18, 19, 20, 21, 22, 23, 24, 25:
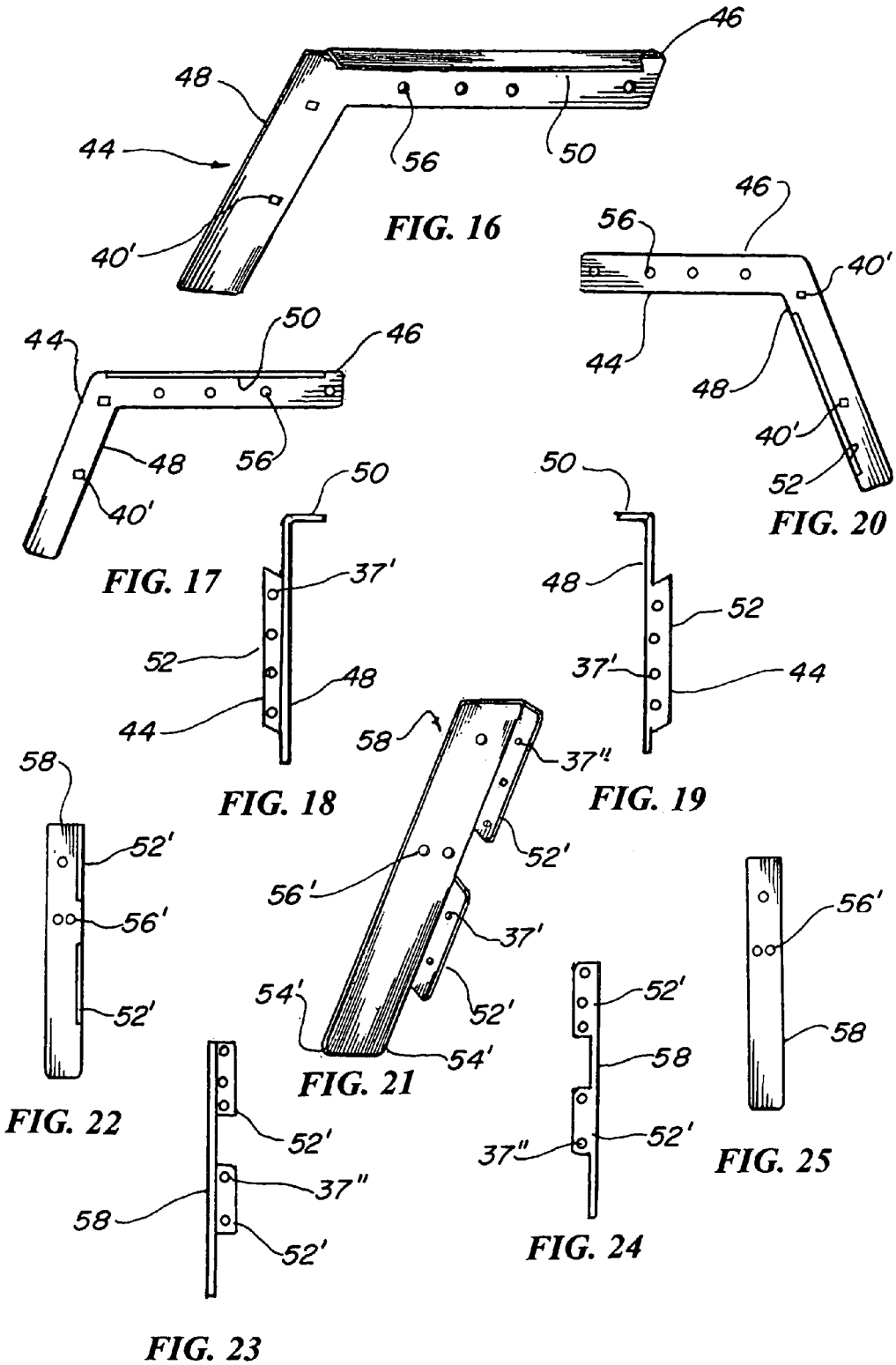
FIG. 16 is a partial isometric view of the cleat arm in the preferred embodiment.
FIG. 17 is a front view of the cleat arm in the preferred embodiment.
FIG. 18 is a right side view of the cleat arm in the preferred embodiment.
FIG. 19 is a left side view of the cleat arm in the preferred embodiment.
FIG. 20 is a rear view of the cleat arm in the preferred embodiment.
FIG. 21 is a partial isometric view of the cleat leg in the preferred embodiment.
FIG. 22 is a front view of the cleat leg in the preferred embodiment.
FIG. 23 is a right side view of the cleat leg in the preferred embodiment.
FIG. 24 is a left side view of the cleat leg in the preferred embodiment.
FIG. 25 is a rear view of the cleat leg in the preferred embodiment.
Figure 26:
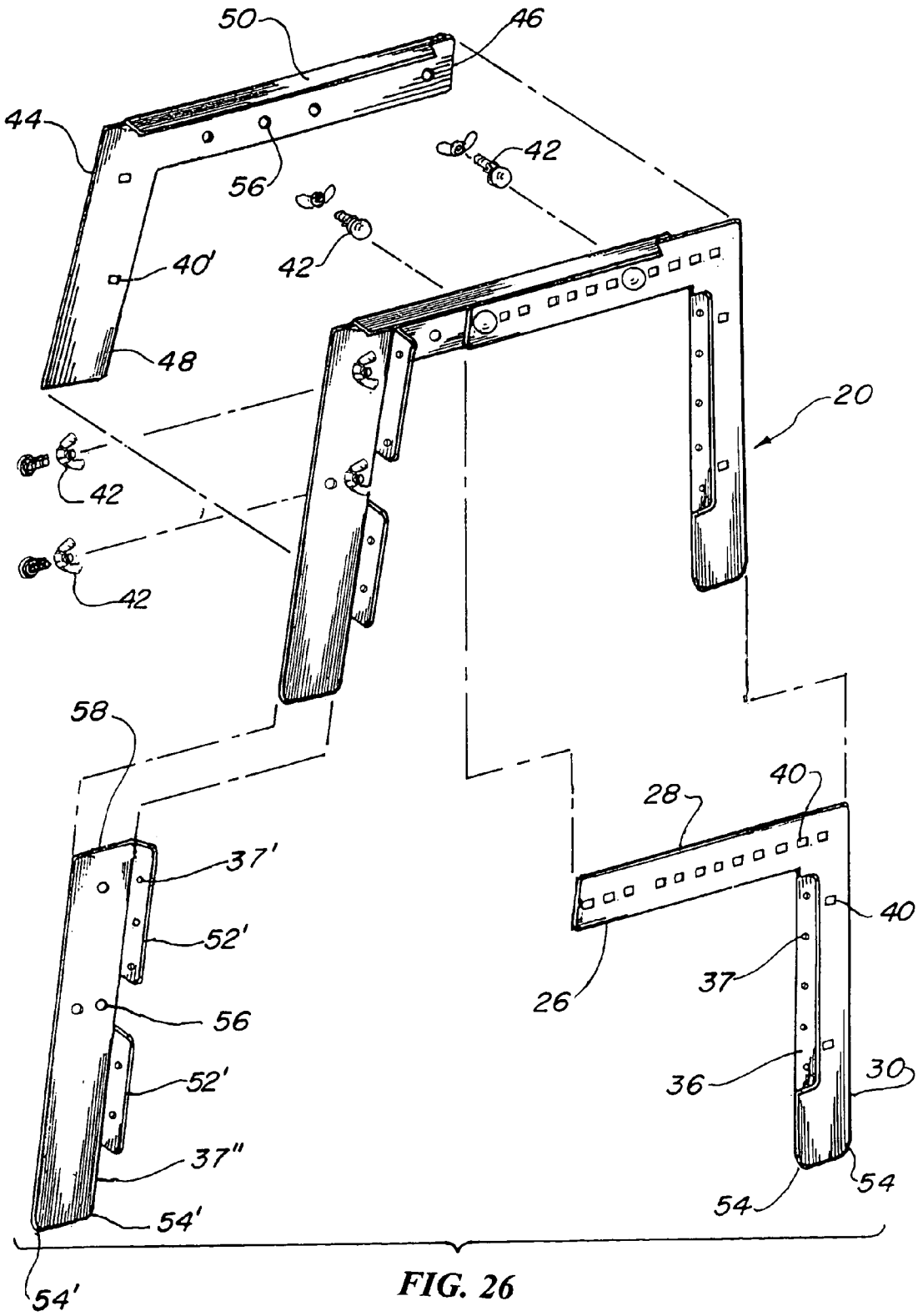
FIG. 26 is an exploded view of the preferred embodiment.

The integral horizontal back top 28 of the right angle shaped cleat back 26 includes an acute angle horizontal back top distal end 38 as illustrated in FIGS. 12 and 15 which permits nesting into another element to provide a minimum width of the cleat when assembled. The integral horizontal back top 28 also includes a plurality of holes spaced to permit inside width adjustment of the cleat 20 of from 4.50 to 10.00 inches (11.43 cm to 25.4 cm) at 0.50 inch (1.27 cm) increments. These holes in the integral horizontal back top 28 are actually square holes 40 that are sized to accommodate carriage head cap screws with wing nuts 42 preventing rotation of the screw when threadably attached with the wing nut. The distal end of the integral downwardly depending member 48 has radiused corners 54 for ease of handling and driving into the ground.

A cleat arm 44 is configured to include an integral horizontal top arm 46 and an integral downwardly depending member 48, formed at an acute angle to the horizontal top arm 46. The cleat arm 44 is attached to the cleat horizontal back top 28 creating an inverted channel shape of the cleat 20, as illustrated in FIG. 1. The cleat arm 44 includes a stiffening flange 50 extending outwardly from the horizontal top arm 46 for reinforcing the arm horizontally. The downwardly depending member 48 has a mounting flange 52 extending outwardly in an opposite direction from the horizontal top arm stiffening flange 50 illustrated best in FIGS. 16–20. The mounting flange 52 includes a plurality of nail holes 37' for nailing the front board 24 in place eliminating the necessity of the spreader 25 or when required by the application.

The cleat arm 44 incorporates a plurality of round holes 56 in the top arm 46 in a pattern that mate with the square holes 40 of the horizontal back top 28, to receive the carriage head capscrews with wing nuts 42 for adjusting the width of the cleat 20. A plurality of round holes 56 are also provided in the downwardly depending member 48 for angular adjustment. To achieve a conventional standard height of a curb in an L-curb and gutter configuration the downwardly depending member 48 has an inside length of 5.00 inches (12.7 cm).

A cleat leg 58, illustrated in FIGS. 21–25, is attached to the downwardly depending member 48 such that it may be adjustably disposed parallel with the back leg 30 or adjusted at an acute angle to the horizontal top arm 46. The cleat leg 58 preferably includes a pair of outwardly facing mounting flanges 52' that are spaced apart sufficiently to provide clearance therebetween for manually adjusting the angle of the cleat arm 44 to said cleat leg 58. The outwardly facing mounting flanges 52' include a plurality of nail holes 37" for nailing the front board 24 in place when required by the application. The adjustment method utilizes a plurality of round holes 56' in the cleat leg 58 that mate with similar square holes 40' in the cleat arm downwardly depending member 48 and carriage head capscrews with wing nuts 42 are positioned within these holes 56' and 40'. The cleat leg 58 has a radiused distal end in the form of radiused corners 54' for ease of handling and driving into the ground.

Adjustment means are provided for attaching the cleat back 26 to the cleat arm 44 also adjustably attaching cleat leg 58 to the cleat arm downwardly depending member 48 utilizing the carriage head capscrews with wing nuts 42 inserted into the square holes 40 and 40' and then through the round holes 56 and 56'. This adjustment means therefore provides a cleat device 20 that is capable of supporting the outside surface of a back board form 22 and a front board form 24 with a spreader 25 spaced apart in-between for constructing an L-curb and gutter, an A-22 curb and also an A-90 curb configuration.

Figure 2:
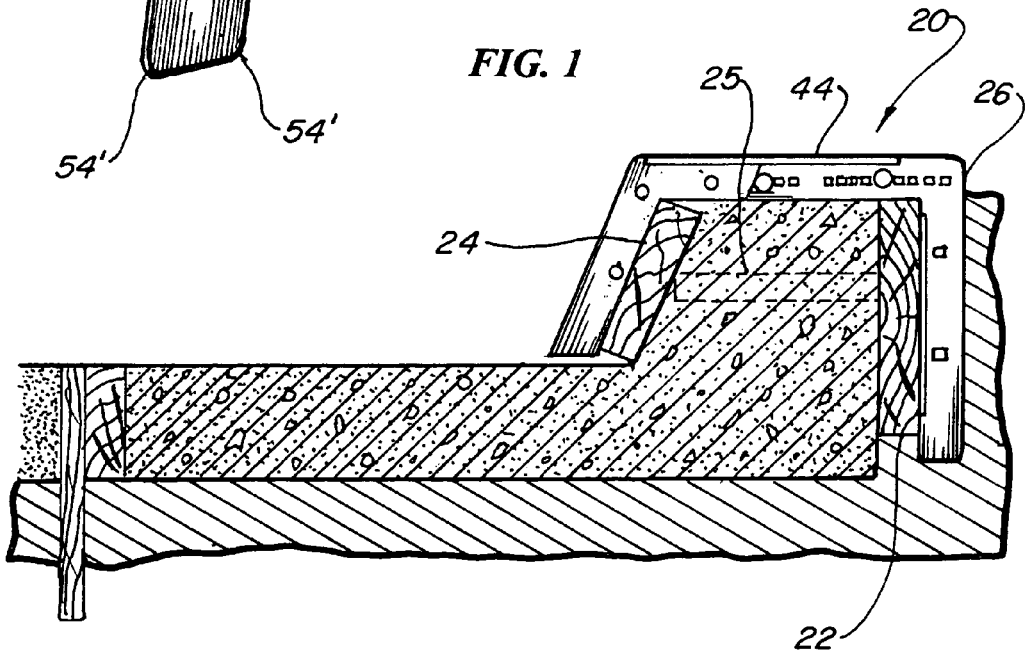
FIG. 2 is an arbitrary cross sectional view of the cleat device adjusted in the L-curb and gutter configuration with the concrete poured in the forms and the spreader shown dotted since it was removed before the concrete was completely poured.
Figure 3:
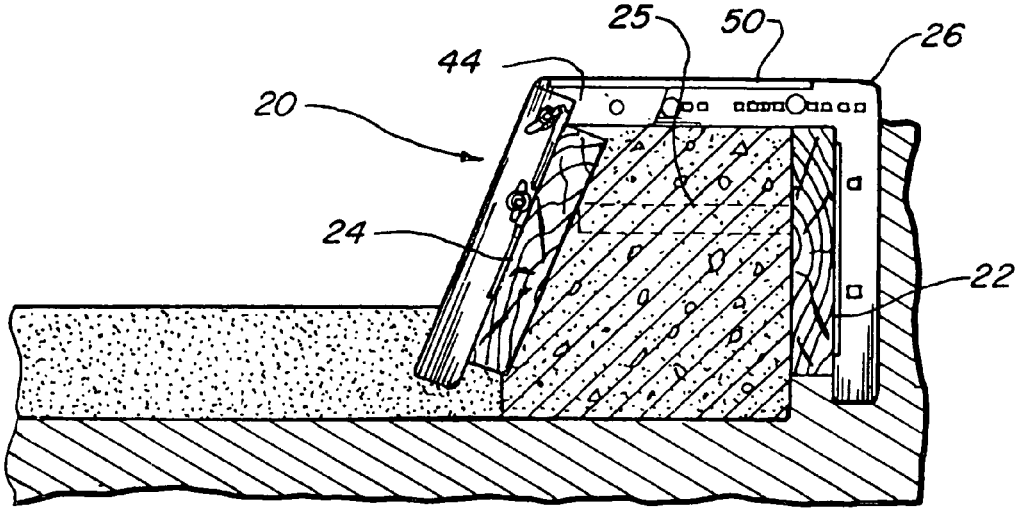
FIG. 3 is an arbitrary cross sectional view of the cleat device adjusted in the A-22 curb configuration with the concrete poured in the forms and the spreader shown dotted since it was removed before the concrete was completely poured.
Figure 4:
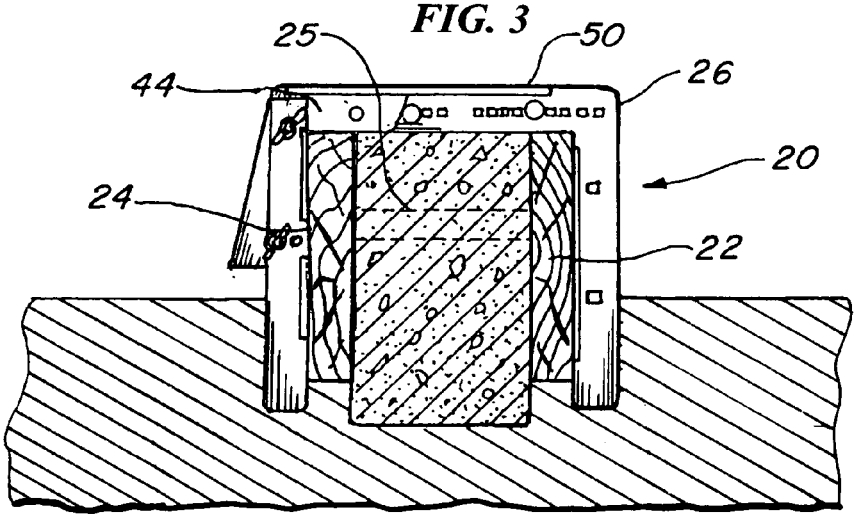
FIG. 4 is an arbitrary cross sectional view of the cleat device adjusted in the A-90 curb configuration with the concrete poured in the forms and the spreader shown dotted since it was removed before the concrete was completely poured.
Figure 5:
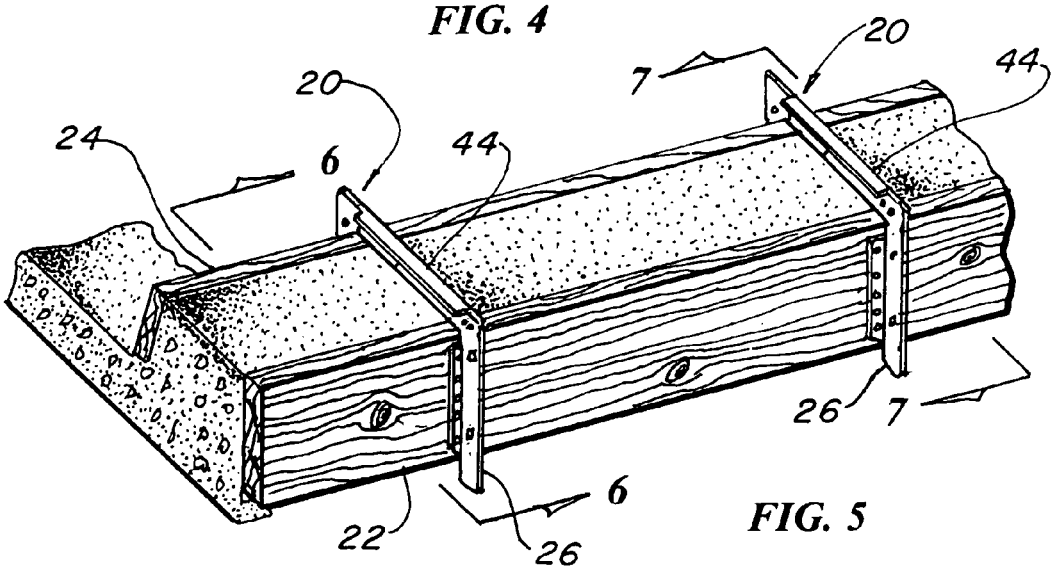
FIG. 5 is a partial isometric view of the cleat device in the A-22 curb configuration of the preferred embodiment with the wood forms in place and the concrete poured.
Figure 6:
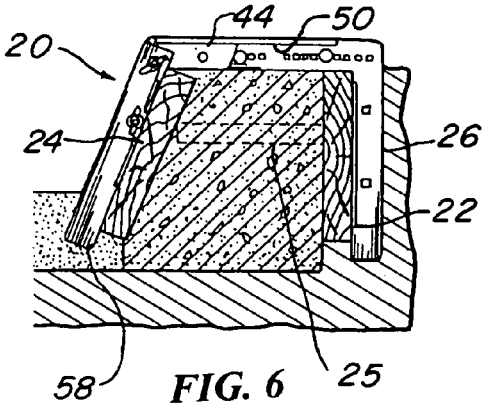
FIG. 6 is a cross sectional view of the preferred embodiment adjusted to the L-curb configuration taken along lines 6—6 of FIG. 5.
Figure 7:
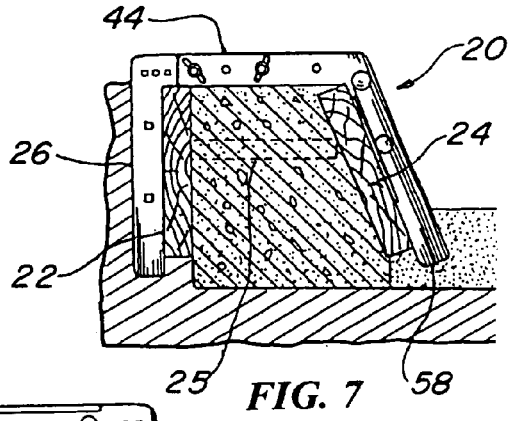
FIG. 7 is a cross sectional view of the preferred embodiment adjusted to the L-curb configuration taken along lines 6—6 of FIG. 5.
Figure 9:
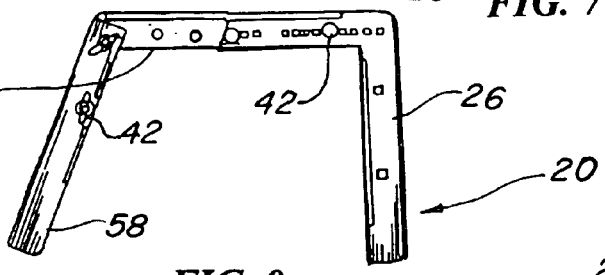
FIG. 9 is a front view of the preferred embodiment adjusted to the L-curb configuration and a maximum width.
Figure 8:
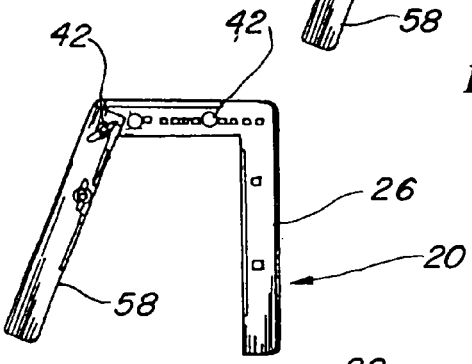
FIG. 8 is a front view of the preferred embodiment adjusted to the L-curb configuration and a minimum width.
Figure 10:
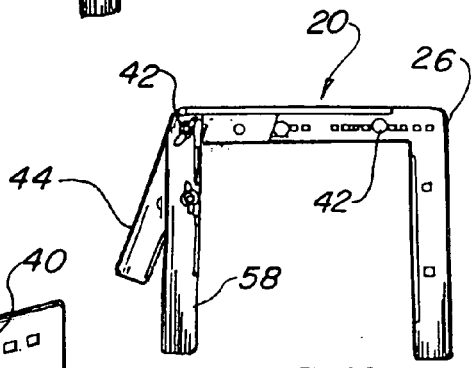
FIG. 10 is a front view of the preferred embodiment adjusted to the A-90 curb configuration and the industry standard width.

The L-curb and gutter configuration consists of attaching the cleat back 26 to the cleat arm 44 utilizing the carriage head capscrews with wing nuts 42 adjusted to the desired width while omitting the cleat leg 48, as shown in FIG. 2. The A-22 configuration consists of attaching the cleat back 26 to the cleat arm 44 and also attaching the cleat leg 58 to said cleat arm 44 to a 22 degree acute angle relative to the cleat top arm 46 by the carriage head capscrews with wing nuts 42 adjusted to the desired width, illustrated in FIG. 3. The A-90 configuration consists of attaching the cleat back 26 to the cleat arm 44 and also attaching the cleat leg 58 to the cleat arm 44 at a 90 degree right angle relative to the cleat top arm 46 adjusted to the desired width using the carriage head capscrews with wing nuts 42 depicted in FIG. 4.

The cleat device 20 may be fabricated of any material suitable for the application such as plastic, fiberglass, cast aluminum, cast iron, injection molded metal etc. with formed sheet metal preferred of a thickness such as 16 gauge, 0.059 inch (1.5 mm), steel, either un-coated or finished with paint, oxide treatment, or metal plating.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ELEMENT DESIGNATION

For Convenience of the Examiner, Not Part of the Specification

20 cleat device
22 back board form
24 front board form
25 spreader
26 cleat back
28 horizontal back top (of 26)
30 downwardly depending back leg (of 26)
32 inner edge (of 30)
34 outer edge (of 30)
36 right angle flange (of 30)
37 nail holes (in 30)
37' nail holes (in 52)
37" nail holes (in 52')
38 acute angle horizontal top distal end (of 28)
40 square holes (in 28)
40' square holes (in 48)
42 carriage head capscrews with wing nuts
44 cleat arm
46 horizontal top arm (of 44)
48 downwardly depending member
50 stiffening flange (on 46)
52 mounting flange (on 48)
52' mounting flange (on 58)
54 radiused corners (on 30)
54' radiused corners (on 58)
56 round holes (in 44)
56' round holes (in 58)
58 cleat leg

The invention claimed is:

1. A cleat device for jointly retaining a back board form and a front board form with a spreader spaced apart in-between comprising, a right angle shaped cleat back configured to intimately engage and retain the back board form, a cleat arm having an integral horizontal top arm and a integral downwardly depending member at an oblique angle to said horizontal top arm, attached to said back forming an inverted channel to intimately engage and retain the front board form, an adjustable cleat leg, attached to said cleat arm, for regulating the angular displacement of the front board form, and two attachment means for adjustably attaching said cleat back to said cleat arm as well as adjustably attaching said cleat leg to said cleat arm.

2. A cleat device, for jointly retaining a back board form and a front board form with a spreader spaced apart in-between, for forming concrete curbing, the cleat device comprising, a right angle shaped cleat back, having an integral horizontal back top and a integral downwardly depending back leg, configured to intimately engage and retain a back board form, a cleat arm having an integral horizontal top arm and a integral downwardly depending member at an oblique angle to said horizontal top arm, attached to said cleat horizontal back top forming an inverted channel, with said downwardly depending member, configured to intimately engage and retain a front board form, a cleat leg, attached to said downwardly depending member such that the cleat leg is adjustably disposed parallel with said back leg or may be adjustably disposed at an oblique angle to said horizontal top arm, and two adjustment means for attaching said cleat back to said cleat arm as well as adjustably attaching said cleat leg to said cleat arm downwardly depending member, providing a cleat device capable of supporting an outside surface of a back board form and a front board form with a spreader spaced apart in-between for constructing an L-curb and gutter, an A-22 curb and also an A-90 curb configuration.

3. The cleat device as recited in claim 2 wherein said right angle shaped cleat back downwardly depending back leg further having an inner edge and an outer edge with a right angle flange formed on the inner edge of the back leg.

4. The cleat device as recited in claim 2 wherein said integral horizontal back top of the right angle shaped cleat back further having an acute angle horizontal back top distal end.

5. The cleat device as recited in claim 2 wherein said right angle shaped cleat back further having a plurality of holes therein integral with said horizontal back top said holes spaced to permit adjustment of from 4.50 to 10.00 inches (11.43 cm to 25.4 cm) between the cleat back and the cleat arm in, at least, 0.50 inch (1.27 cm) increments.

6. The cleat device as recited in claim 5 wherein said holes integral with said horizontal back top comprise, square holes sized to accommodate carriage head cap screws.

7. The cleat device as recited in claim 2 wherein cleat back integral downwardly depending back leg further having a radiused distal end.

8. The cleat device as recited in claim 2 wherein said cleat arm further comprises stiffening flange extending outwardly on said horizontal top arm.

9. The cleat device as recited in claim 8 wherein said cleat arm integral downwardly depending member further having a mounting flange extending outwardly in an opposite direction from the horizontal top arm stiffening flange.

10. The cleat device as recited in claim 2 wherein said cleat arm integral downwardly depending member further having a plurality of holes for angular adjustment with said cleat leg.

11. The cleat device as recited in claim 2 wherein said cleat arm integral downwardly depending member further having an inside length of 5.00 inches (12.7 cm) to achieve a conventional standard height of a curb in an L-curb and gutter configuration.

12. The cleat device as recited in claim 2 wherein said cleat leg further having a pair of outwardly facing flanges that incorporate clearance therebetween for said adjustment means attaching said cleat arm to said cleat leg.

13. The cleat device as recited in claim 2 wherein said cleat leg further having a plurality of holes for angular adjustment.

14. The cleat device as recited in claim 2 wherein said cleat leg further having a radiused distal end.

15. The cleat device as recited in claim 2 wherein said adjustment means for attaching said cleat back to said cleat arm also adjustably attaching said cleat leg to said cleat arm further comprises a plurality of carriage bolts with wing nuts.

16. The cleat device as recited in claim 2 wherein said adjustment means further comprises said cleat back mounted to said cleat arm for constructing an L-curb and gutter.

17. The cleat device as recited in claim 2 wherein said adjustment means further comprises, said cleat back mounted to said cleat arm as well as said cleat leg mounted to said cleat arm adjusted to a 22 degree acute angle relative to said cleat top arm for constructing an A-22 curb.

18. The cleat device as recited in claim 2 wherein said adjustment means further comprises, said cleat back mounted adjustably to said cleat arm as well as said cleat leg mounted adjustably to said cleat arm at a 90 degree right angle relative to said cleat top arm for constructing an A-90 curb.

19. The cleat device as recited in claim 2 wherein said cleat back, said cleat arm and said cleat leg further comprising 16 gauge, 0.059 inch (1.5. mm), steel construction.

* * * * *